United States Patent [19]

Brass et al.

[11] 4,013,291

[45] Mar. 22, 1977

[54] GAME WITH DETECTOR ASSEMBLY PROVIDING A STORED INDICATION OF THE PASSAGE OF THE ASSEMBLY OVER A MAGNET CONCEALED IN A GAME BOARD

[75] Inventors: Robert L. Brass, Westport, Conn.; Arthur P. Venditti, Peabody; Samuel T. Kjellman, Framingham, both of Mass.

[73] Assignee: Robert L. Brass, Westport, Conn.

[22] Filed: Nov. 24, 1975

[21] Appl. No.: 634,608

[52] U.S. Cl. ..... 273/130 A; 46/239; 273/1 M; 273/130 D; 273/137 AE; 273/137 AB; 273/139

[51] Int. Cl.[2] ..... A63F 3/00

[58] Field of Search .... 273/130 A, 130 D, 131 AD, 273/134 AE, 135 AB, 135 AD, 137 AE, 137 AB, 1 M, 139; 46/238, 239; 324/3, 41

[56] References Cited

UNITED STATES PATENTS

| | | | |
|---|---|---|---|
| 2,295,452 | 9/1942 | Deaton | 273/134 AE |
| 2,673,404 | 3/1954 | Abrahamson | 273/1 M |
| 2,749,663 | 6/1956 | Lemelson | 46/239 |
| 3,406,974 | 10/1968 | Nelson | 273/134 AE |
| 3,427,029 | 2/1969 | Riva | 273/135 AD |
| 3,543,146 | 11/1970 | Sherwood | 273/130 A |
| 3,801,104 | 4/1974 | Potts et al. | 273/134 AE |
| 3,845,384 | 10/1974 | Stoutenberg et al. | 324/41 |

*Primary Examiner*—Harland S. Skogquist
*Assistant Examiner*—Harry G. Strappello
*Attorney, Agent, or Firm*—Haynes N. Johnson

[57] ABSTRACT

A new treasure hunt game is played by concealing magnets in a game board and passing a detector assembly in a path over the game board to provide a concealed stored indication, retrievable later, that the detector's path has intercepted a concealed magnet. The detector assembly includes a pivotable indicator having two gravitationally stable positions, and magnetic means in the indicator for pivoting it from one stable position to the other stable position as the magnetic field of a concealed magnet is encountered. The indicator remains in its second stable position after once passing over a concealed magnet to store the indication. A housing with a retractable cover encloses the indicator, and a cushioned stop for the indicator absorbs noise and vibration, so that an indication is hidden from a player moving the detector assembly until a selected juncture in the game.

12 Claims, 8 Drawing Figures

GAME WITH DETECTOR ASSEMBLY PROVIDING A STORED INDICATION OF THE PASSAGE OF THE ASSEMBLY OVER A MAGNET CONCEALED IN A GAME BOARD

BACKGROUND OF THE INVENTION

This invention relates to game equipment, and more particularly to equipment for games of the type played with a game board and pieces moved thereover.

A principal object of the present invention is to provide unique game equipment with characteristics suitable for many enjoyable games. It is a specific object of the invention to provide a game in which concealed elements are deployed upon the game board and a detector assembly is moved over the game board and generates an indication upon encountering a concealed element. Still another object of the invention is to provide such a detector assembly which can hide the indication from a player and store the indication so it can be retrieved later at a selected juncture in the game. Still another object of the invention is to provide a game of the type described which is suitable for economical commercial manufacture.

SUMMARY OF THE INVENTION

In a preferred embodiment of the invention to be described hereinbelow in detail, the new game is played by concealing magnets in a game board and passing a detector assembly in a path over the game board to provide a concealed stored indication, retrievable later, that the detector's path has intercepted a concealed magnet. The detector assembly is arranged with a pivotable indicator having two gravitationally stable positions, and magnetic means such as a bar magnet for pivoting the indicator from one stable position to the other stable position as the indicator passes over a concealed magnet and encounters its magnetic field, the indicator thereafter remaining in the second stable position to provide a lasting indication of the passage over a concealed magnet. This arrangement is not only easily and inexpensively constructed, but also quite reliable in use. In further aspects of the invention, the indicator is enclosed within a housing having a retractable cover, and a cushioned stop for the indicator absorbs noise and vibration as the indicator moves to its other stable position, so that the action of the detector assembly is hidden from a player until, at a suitable juncture in the game, he is permitted to retract the cover on the housing and view the position of the indicator.

Other objects, aspects and advantages of the invention will be pointed out in, or apparent from, the detailed description hereinbelow, considered together with the following drawings.

DESCRIPTION OF THE PREFERRED EMBODIMENT

Figure 1:
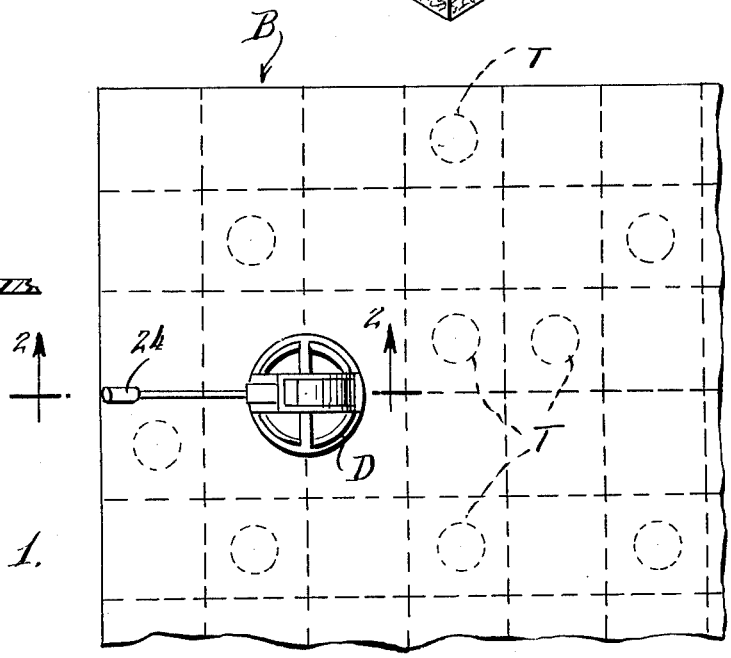
FIG. 1 is a plan view of a game board and detector assembly in accordance with the present invention.

Referring first to FIG. 1, the game equipment of the present invention comprises a game board B arranged to hold concealed magnets T in positions selected by the players, and one or more detector assemblies D arranged to be moved over the surface of the game board and to provide and store an indication that the detector's path has gone over a concealed magnet.

Figure 2:
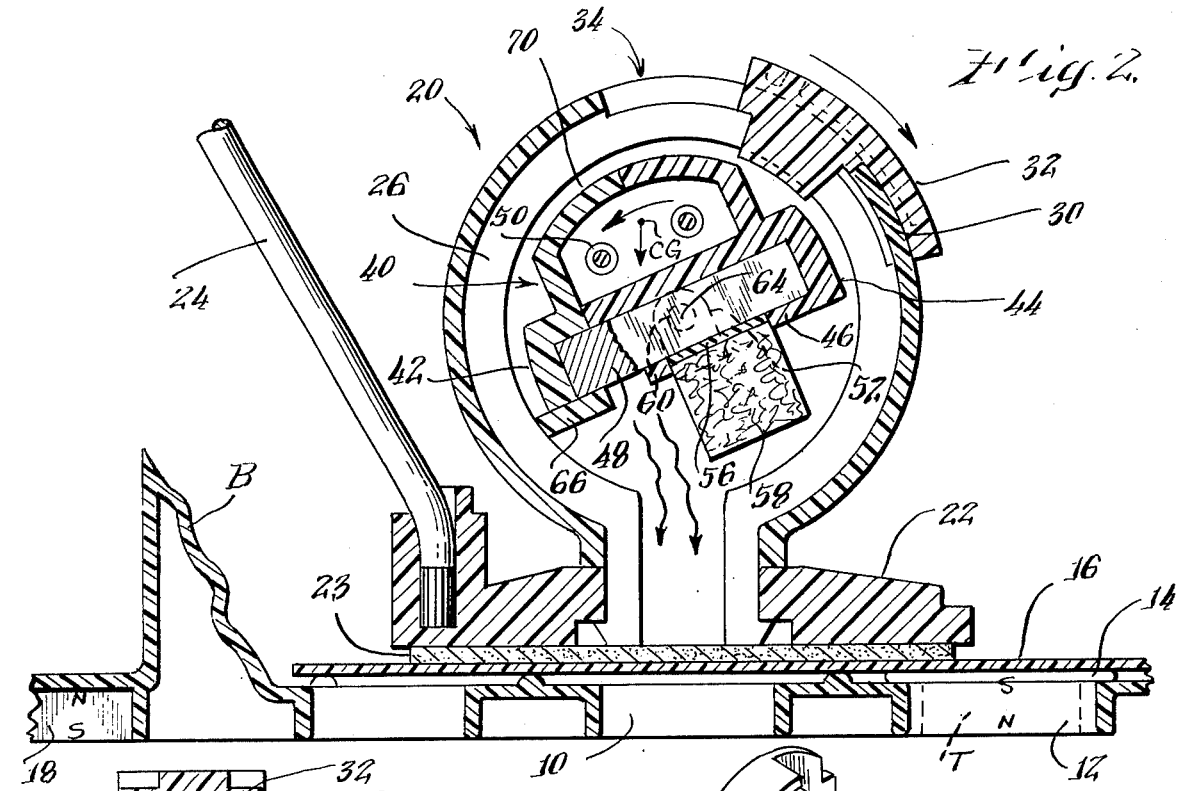
FIG. 2 is a vertical section on line 2—2 of FIG. 1, showing the indicator assembly in one stable position.

As shown in FIG. 2, the game board B is provided with a pattern of recesses 10 sized to accept cylindrical holders 12 containing the concealed magnets T. The magnet holders 12 have upper flanges 14 limiting the extent of their insertion into recesses 10, and also providing uniform orientation of the concealed magnets with their south poles uppermost. A removable surface layer 16, with game patterns annd the like printed thereon, overlies the magnets T and conceals them from view by the players. As will be described below, the game board 8 also includes a resetting magnet 18 positioned with its north pole uppermost. The game board and magnet holders 12 preferably are made from molded plastic.

The detector assembly D comprises a housing 20 formed with a base member 22 carrying a felt pad 23 and a handle 24 arranged to receive, with a snap fitting interlock, the lower ends of mating side shells 26 and 28. The side shells 26, 28 have inwardly-directed arcuate guides 30 which slidingly mount a retractable cover 32. An opening or window 34 formed between shells 26, 28 is either opened (FIG. 2) or closed (FIG. 3) by means of cover 32.

Figure 4:
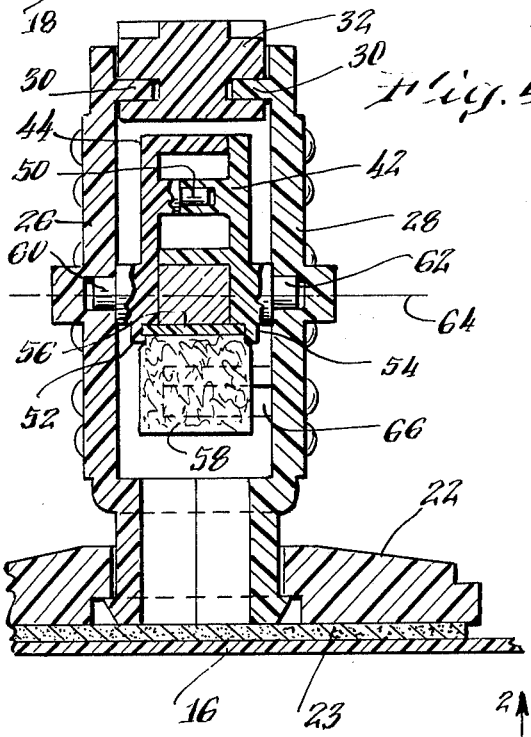
FIG. 4 is a section on line 4—4 of FIG. 3.
Figure 5:
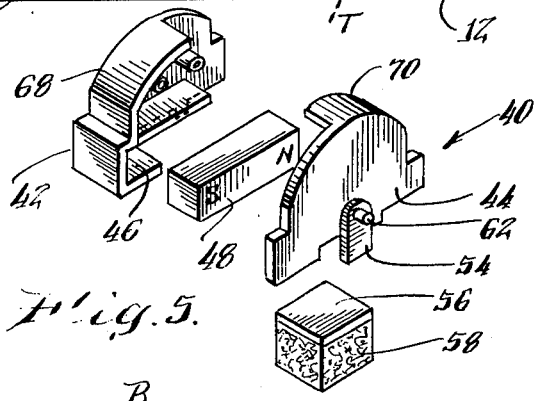
FIG. 5 is an exploded perspective view of the indicator assembly portion of the detector.

Enclosed within housing 20, and visible only through window 34, is an indicator assembly 40 pivotally supported by shells 26, 28. The indicator assembly 40, shown exploded in FIG. 5, comprises mating side portions 42 and 44 molded from different colored plastic materials for a reason to be explained below, and forming a compartment 46 to carry a small bar magnet 48. The side portions 42, 44 are joined together with press fitted studs 50 (FIG. 4) and have downwardly extending tabs 52, 54 to grip therebetween a plate 56 cemented to a block 58 of shock absorbing and cushioning plastic foam. Stub axles 60, 62 on the side pieces 42, 44 fit in corresponding journals provided in the shells 26, 28 to permit the indicator assembly 40 to pivot about a horizontal axis 64 lying midway between the poles of bar magnet 48 (FIGS. 2, 4).

Figure 3:
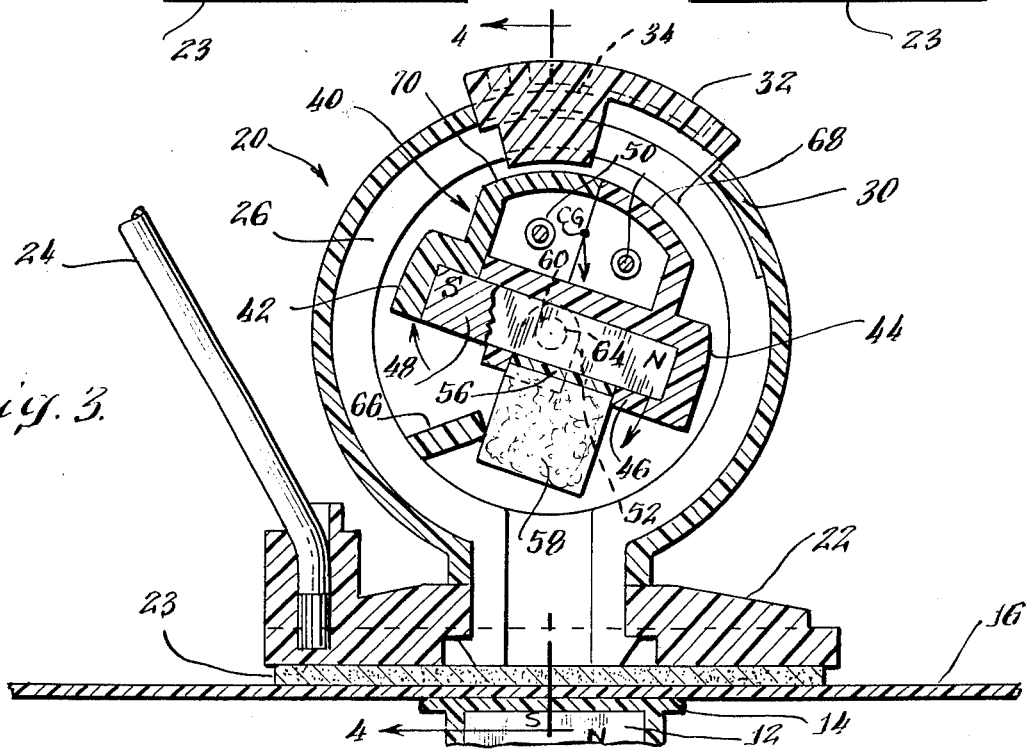
FIG. 3 is a section similar to FIG. 2, showing the indicator assembly in its other stable position.

As shown in FIG. 2, indicator assembly 40 is shaped so that its center of gravity CG is located above pivot axis 64, and thus gravitational forces will cause indicator assembly 40 to rotate counterclockwise if the center of gravity CG is to the left of pivot axis 64 (as shown in FIG. 2) or to rotate clockwise if the center of gravity CG is to the right of pivot axis 64 (as shown in FIG. 3). Two gravitationally stable positions for indicator assembly 40 are defined by a stop 66 provided on shell 28 and engaging either side pieces 42, 44 (FIG. 2) or engaging foam cushion 58 (FIG. 3).

The stop 66 and foam cushion 58 are postioned so that when the indicator assembly is in the one stable position shown in FIG. 2, the upper arcuate portion 68 of side piece 42 is visible through window 34, whereas the other stable position (FIG. 3) locates upper arcuate portion 70 of side piece 44 opposite window 34. As stated previously, the side pieces 42 and 44 are made of different colored materials (e.g., red and gray) and thus upper portions 68 and 70 provide visually distinct surfaces viewable through the window 34 to correspond to the two different gravitationally stable positions of the indicator assembly 40.

Detector assembly D is used for detecting and indicating passage over a concealed magnet T in the following manner. Indicator assembly 40 is initially positioned in the stable state shown in FIG. 2. The detector D is then moved across the surface of game board B in accordance with a game pattern. When detector D passes above a concealed magnet T, as shown in FIG. 3, the magnetic field of the concealed magnet, having its south pole uppermost, both repels the south pole and attracts the north pole of bar magnet 48. Because bar magnet 48 is situated with its south and north poles on opposite sides of pivot axis 64, the forces attracting the north pole and repelling the south pole apply additive torques to indicator assembly 40, causing it to rotate clockwise as seen in FIG. 3 until foam cushion 58 rests against stop 66. The indicator assembly then is in its other stable position, with the center of gravity CG to the right of pivot axis 64, and with upper portion 70 of side piece 42 opposite window 34. The indicator assembly remains in the stable position shown in FIG. 3 and stores the indication until being reset, which can be accomplished either by tipping the detector assembly D or by placing it above the resetting magnet 18 which has its north pole uppermost and thus applies a reverse torque to indicator assembly 40.

The energy and momentum imparted to indicator assembly 40 in rotating it to the stable position shown in FIG. 3 is substantially absorbed and dissipated by shock absorbing cushion 58 whhen it engages stop 66. Accordingly, noise and vibration are kept to a low level which cannot be sensed by a player, and thus detector assembly D is capable of masking the action of the indicator assembly in changing to its other stable position as it passes over a concealed magnet T. Such an indication is also visually hidden by cover 32 over window 34 until, at a permitted juncture in the game, the player is allowed to retract cover 32 and look through window 34 to determine whether the upper surface 70, e.g., colored red, can be seen through the window to indicate a concealed magnet has been encountered, or the upper surface 68, e.g., colored gray, is present to indicate that the path of detector assembly D has not crossed over a concealed magnet.

Accordingly, detector assembly D provides a stored indication, retrievable later by a player, that the detector's path has intercepted a concealed magnet.

Figure 6:
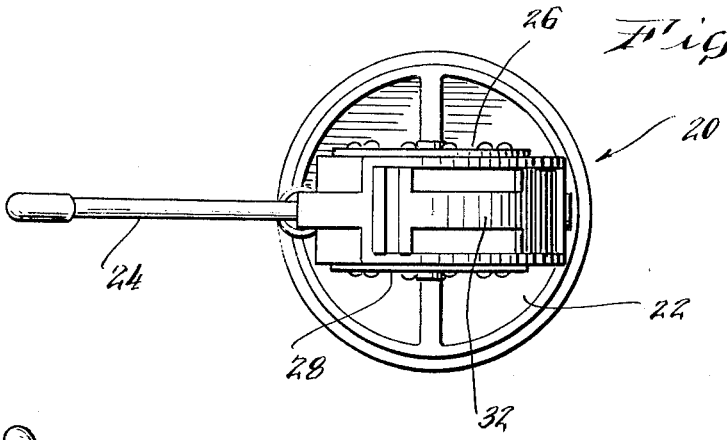
FIGS. 6, 7 and 8 illustrate the detector assembly in plan, side elevation, and front elevation views respectively.
Figure 8:
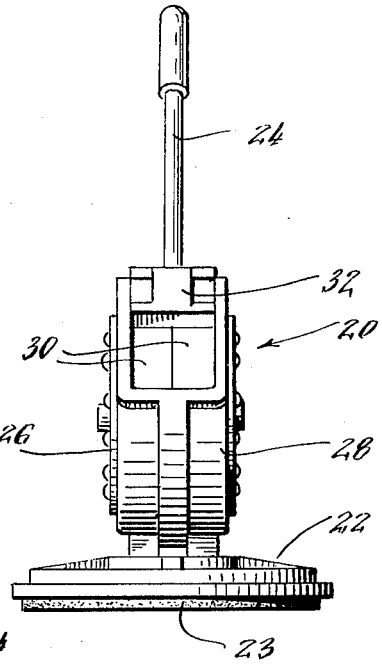
Figure 7:
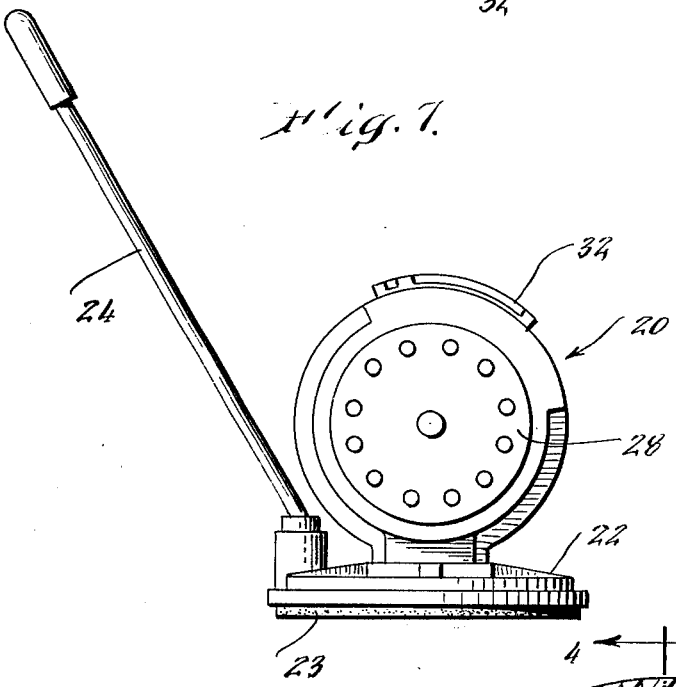

As shown in FIGS. 6, 7 and 8, detector assembly D may be given the outward appearance of a metal detector. Such an appearance is appropriate, for example, in a treasure hunt game in which the concealed magnets T represent treasures hidden by one player to be located by another player. Other outward appearances and configurations for detector assembly D, and game board B, and magnets T will be appropriate for games having other themes and purposes.

Although a specific embodiment of the invention has been disclosed herein in detail, it is to be understood that this is for the purpose of illustrating the invention, and should not be construed as necessarily limiting the scope of the invention, since it is apparent that many changes can be made to the disclosed structures by those skilled in the art to suit particular applications.

We claim:

1. A detector assembly arranged to be used in a game for indicating passage of the assembly over a magnet concealed in a game board, comprising:

a pivotable indicator having two stable positions;

means for selectively concealing the indicator; and magnetic means in the indicator for pivoting the indicator from one stable position to the other stable position as the indicator passes over a concealed magnet and encounters its magnetic field;

the indicator remaining in the second stable position after once passing over a concealed magnet to provide a lasting indication thereof.

2. A detector assembly as claimed in claim 1 wherein the magnetic means in the indicator comprises a bar magnet positioned approximately horizontally when the indicator is in its first stable position.

3. A detector assembly as claimed in claim 1 wherein the magnetic means comprises a bar magnet positioned with its poles on opposite sides of the pivot axis of the indicator so that magnetic forces attracting one pole and repelling the other pole apply additive torques to the indicator.

4. A detector assembly as claimed in claim 3 wherein the bar magnet is positioned to intersect the pivot axis of the indicator.

5. A detector assembly arranged to be used in a game for indicating passage of the assembly over a magnet concealed in a game board, comprising:

a pivotable indicator having two stable positions;

magnetic means in the indicator for pivoting the indicator from one stable position to the other stable position as the indicator passes over a concealed magnet and encounters its magnetic field;

the indicator remaining in the second stable position after once passing over said concealed magnet to provide a lasting indication thereof; and magnetic means in the indicator for pivoting the indicator from one stable position to the other stable position as the indicator passes over a concealed magnet and encounters its magnetic field;

the indicator remaining in the second stable position after once passing over a concealed magnet to provide a lasting indication thereof; and a housing enclosing the indicator and pivotally supporting it for movement about a horizontal axis;

the housing having window means for viewing the position of the indicator and a retractable cover for the window means;

the indicator having a first portion viewable through the window means when the indicator is in its one stable position and a second visually distinct portion viewable through the window means when the indicator is in its other stable position; and stop means for defining the two stable positions of the indicator, said stop means including a shock absorbing cushion for reducing vibration and noise as the indicator moves into its other stable position.

6. A detector assembly as claimed in claim 5 wherein the shock absorbing cushion is attached to and moves with the indicator.

7. A detector assembly arranged to be used in a game for indicating passage of the assembly over a magnet concealed in a game board, comprising:

a pivotable indicator having two stable positions;

magnetic means in the indicator for pivoting the indicator from one stable position to the other stable position as the indicator passes over a concealed magnet and encounters its magnetic field;

the indicator remaining in the second stable position after once passing over said concealed magnet to provide a lasting indication thereof; and a housing enclosing the indicator, said housing having window means to permit viewing of the position of the indicator and a retractable cover over the window means for concealing the indicator to prevent determination until an appropriate time of the position of the indicator.

8. A detector assembly as claimed in claim 7 wherein the indicator comprises a first portion viewable through the window means when the indicator is in its first stable position, and a second visually distinct portion viewable through the window means when the indicator is in its second stable position.

9. A detector assembly as claimed in claim 8 wherein the two indicator portions have different colors.

10. A detector assembly arranged to be used in a game for indicating passage of the assembly over a magnet concealed in a game board, comprising:

a pivotable indicator having two stable positions;

magnetic means in the indicator for pivoting the indicator from one stable position to the other stable position as the indicator passes over a concealed magnet and encounters its magnnetic field;

the indicator remaining in the second stable position after once passing over a concealed magnet to provide a lasting indication thereof; and a housing enclosing the indicator and pivotally supporting it for movement about a horizontal axis;

the housing having window means for viewing the position of the indicator and a retractable cover for the window means;

the indicator having a first portion viewable through the window means when the indicator is in its one stable position and a second visually distinct portion viewable through the window means when the indicator is in its other stable position; and stop means for defining the two stable positions of the indicator, said stop means including a shock absorbing cushion for reducing vibration and noise as the indicator moves into its other stable position.

11. A treasure hunt game comprising:

a game board arranged to have one or more magnets concealed therein; and a detector assembly arranged to be moved in a path over the game board in accordance with a game pattern to indicate at a selected juncture in the game that the path has or has not intercepted a concealed magnet;

the detector assembly including a concealable indicator moveable between two positions, means for selectively concealing the indicator, and means for moving the indicator from one position to the other position as the indicator passes over a concealed magnet in the game board and encounters its magnetic field, the indicator remaining in the second position after once passing over a concealed magnet to provide a lasting indication thereof.

12. A treasure hunt game comprising:

a game board arranged to have one or more magnets concealed therein; and a detector assembly arranged to be moved in a path over the game board in accordance with a game pattern to indicate at a selected juncture in the game that the path has or has not intercepted a concealed magnet;

the detector assembly including a concealable indicator moveable between two positions and means for moving the indicator from one position to the other position as the indicator passes over a concealed magnet in the game board and encounters its magnetic field, the indicator remaining in the second position after once passing over a concealed magnet to provide a lasting indication thereof;

said indicator being pivotable between two gravitationally stable positions, and said means for moving the indicator comprising magnetic means in the indicator for pivoting it from one stable position to the other stable position.

* * * * *

UNITED STATES PATENT OFFICE

CERTIFICATE OF CORRECTION

Patent No. 4,013,291 Dated March 22, 1977

Inventor(s) Robert L. Brass, Arthur P. Venditti, Samuel T. Kjellman

It is certified that error appears in the above-identified patent and that said Letters Patent are hereby corrected as shown below:

Delete Column 4, Line 40 starting with "magnetic means" through and including "stable position." at Column 4, Line 60, and in lieu thereof insert the following:

-- stop means engageable with the indicator for defining the two stable positions, said stop means comprising a shock absorbing cushion arranged to reduce noise and vibration as the indicator pivots into the other stable position, thereby to mask the action of the indicator. --

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*